United States Patent [19]

Lindner et al.

[11] 4,069,639

[45] Jan. 24, 1978

[54] WALL ASSEMBLY

[76] Inventors: Robert L. Lindner, 225 Clyde Drive, Walnut Creek, Calif. 94598; Luther E. Marshall, 21 Viewridge Road, Novato, Calif. 94947

[21] Appl. No.: 666,986

[22] Filed: Mar. 15, 1976

Related U.S. Application Data

[60] Division of Ser. No. 406,446, Oct. 15, 1973, which is a continuation of Ser. No. 262,860, June 14, 1972, abandoned, which is a continuation-in-part of Ser. No. 174,843, Aug. 25, 1971, abandoned.

[51] Int. Cl.[2] ..... E04B 1/00

[52] U.S. Cl. ..... 52/745

[58] Field of Search ..... 52/DIG. 4, 745, 481, 52/483, 173, 422, DIG. 13

[56] References Cited

U.S. PATENT DOCUMENTS 3,852,935 12/1974 Jones ..... 52/DIG. 4 X

*Primary Examiner*—Price C. Faw, Jr.
*Assistant Examiner*—Carl D. Friedman
*Attorney, Agent, or Firm*—Townsend and Townsend

[57] ABSTRACT

A wall assembly having a number of wall panels, each wall panel having quick-release fastening means on the inner face thereof for attachment to the vertical studs defining the backing support for the wall panels. After the walls have been put into place in releasable attachment to the studs, they can be secured such as by screws or the like to the studs or to the floor runners above which the studs extend. An improved tape is used as the fastening means.

1 Claim, 8 Drawing Figures

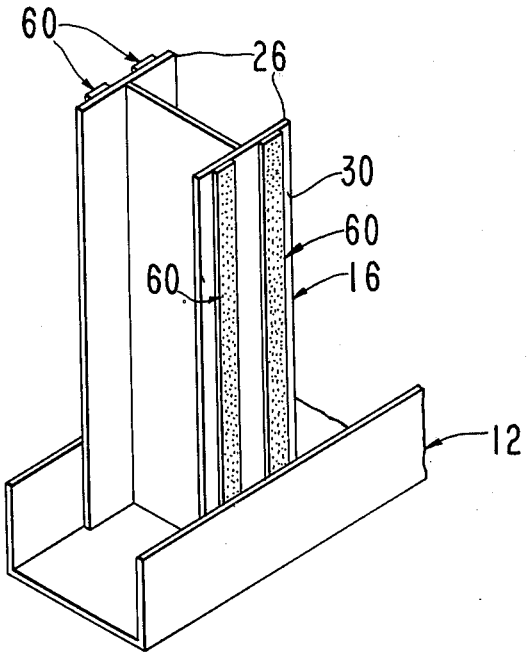
FIG. 4
FIG. 5
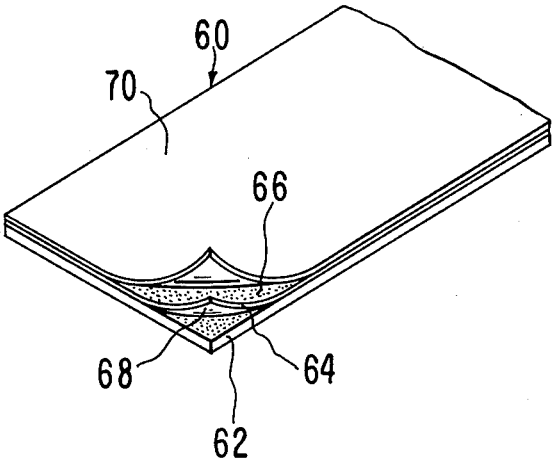
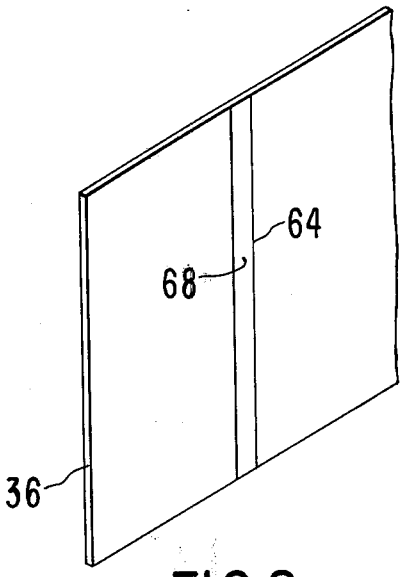
FIG. 8
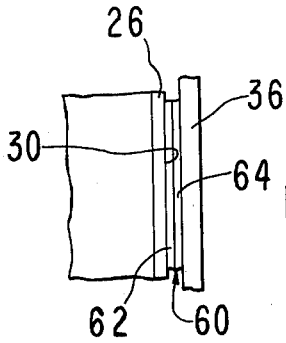
FIG. 6
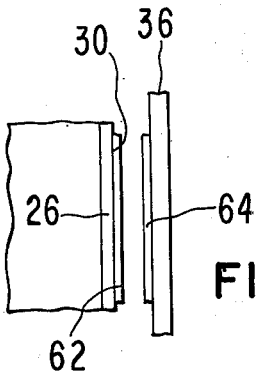
FIG. 7

WALL ASSEMBLY

This is a division of application Ser. No. 406,446, filed Oct. 15, 1973 which is a continuation application of Ser. No. 262,860 filed June 14, 1972 now abandoned which is a continuation-in-part of Ser. No. 174,843 filed Aug. 25, 1971 now abandoned.

This invention relates to improvements in the construction of walls such as the dry wall type and, more particularly, to a wall assembly whose wall panels can be secured by a quick-release fastener to conventional studs.

The conventional dry wall panel is known as a progressive type in which the panel has a projection defining a tongue at one vertical margin thereof and a recess defining a groove at the opposite vertical margin. Thus, the tongue on one panel is received within the groove of the next adjacent panel and the panels must be moved in the plane of the wall to be formed to allow the tongues to be received within the grooves. This is accomplished, of course, after the upper and lower runners are secured in place, the upper runner being secured to the ceiling and the lower runner being secured to the floor. To mount each panel in place, the panel must be tilted so that it is received within the upper runner, then brought into a vertical position and lowered so that it is adjacent to the floor runner. Then the panel is moved sideways until the tongue thereof is received within the groove of the next adjacent panel. The panel is then secured in place such as by screws or the like. For progressive panels, the panels on both sides of a given panel must be coupled to the given panel to form a complete wall assembly.

Other attempts to interconnect conventional panels and studs have been made but they have been, for the most part, extremely complicated to produce and to use. For instance, fasteners formed of hooks have been provided both on the inner surfaces of the wall panels and on the studs for mating relationship. This type of structure also requires that the wall panels be moved sideways into abutment with the next adjacent wall panel. These steps take time because of the labor required to bring the hooks together and to interconnect them properly.

The present invention provides a wall construction which does not have the above-mentioned limitations of progressive panels so as to simplify the mounting of a number of wall panels on studs to form a completed wall. To this end, the invention utilizes quick-release fastening means which connects the inner surfaces of the panels with the contiguous surfaces of the vertical studs to thereby eliminate the need for the tongue and groove features mentioned above; thus, the panels can be inserted and removed quickly and directly as needed without having to move them sideways as is required with conventional panels with the tongue and groove and hook features. Once the panels are vertically disposed, they can be secured by screws to the floor runner to complete the wall panel installation.

One form of the quick-release fastening means includes fasteners commercialized under the registered trademark VELCRO by Velcro Corporation, 681 Fifth Avenue, New York, N. Y. Such a fastener includes a loop tape and a hook tape which mate with each other to provide a releasable attachment therebetween. When used with the present invention, one of the two tapes is secured to the unexposed surface of each wall panel and the other tape is secured to the contiguous surface of the adjacent stud. When the wall panel moves adjacent to the stud, the two tapes move into engagement with each other so that the hooks of the hooked tape intertwine with the loops of the looped tape to provide the means by which the wall panel is releasably interconnected to the stud. The tapes will be sufficiently long to provide the necessary connection sufficient to permit a more permanent connection to be made, such as by driving screws through the wall panel and into the floor runner.

Another fastener suitable for this purpose is a strip of double-backed tape secured either to the unexposed surface of the wall panel or to the contiguous surface of the vertical stud. Such a tape has an adhesive on both sides and adheres to both the wall panel and the stud when the wall panel is moved adjacent to the stud. The connection made by such tape will be sufficient to permit screws to be driven through the wall panel and into the floor runner to provide a more permanent connection.

While the foregoing types of fasteners have been described as including tapes, it is clear that such materials, in the form of short lengths or disks, could be used at spaced locations, the only criterion being that the wall panels are sufficiently connected, even though temporarily, to the studs so that a more permanent connection, such as by screws or the like, can be made. The features of this invention also permit quick disassembly of wall panels from the studs because, once the permanent fasteners are removed, the wall panels can be quickly and easily separated from the studs because of the releasable features of the quick-release fastening means.

Another form of the quick-release fastening means is a tape unit comprised of a first, base tape for adhesive attachment to a stud and a second, outer tape secured to the base tape for adhesive attachment to a wall panel. The first tape has an adhesive on both faces; whereas, the second tape has an adhesive only on its outer face but has a generally smooth, preferably glossy inner face so that it will adhere quite readily to the first tape.

The tape unit is especially suitable for use with drywall panels, such as gypsum wallboard, because the sides of such panels are of cheap paper stock. When tape is applied to the panel side and then peeled off, it causes fuzzy or furry areas to be formed in the paper. The tape cannot thereafter be made to adhere to such fuzzy areas because the looseness or fuzziness of the paper fibers in these areas prevents the tape from properly adhering to the panel a second time.

The tape unit of this invention overcomes this problem because the second tape of the unit separates from the first tape and remains on a wall panel when the latter, previously secured by the tape unit to a stud, is moved away from the stud, such as occurs if the wall assembly is to be partially disassembled for one reason or another. The bond between the second tape and the panel side has a greater resistance to separation of these two elements than the bond between the first and second tapes. This feature can be realized if, for instance, the first tape is made from a thin layer of plastic foam and the second tape is made from paper of a quality better than that used on the aforesaid drywall panels.

As the panel is separated from the stud, the first tape of the tape unit continues to adhere to the stud. Thus, when the panel is re-positioned in place, the second tape, adhering to the side of the panel, presents a smooth surface readily movable into engagement with and in bonding relationship to the first tape because of the adhesive on the latter. The tape unit, therefore, has the following advantages: it assures that the cheap paper of the panel side will not be peeled away if it becomes necessary to remove the panel; it assures that the panel can be readily removed and firmly re-attached a number of times to the stud; it allows the panel to be put in place and removed a number of times without having to move adjacent panels; and it provides a means of absorbing sound to minimize sound travel through the panel.

Tape units of this invention are preferably applied by machine to the opposed flange faces of the stud before the stud is mounted in place. The second tape of each unit can be provided with a release paper strip to protect its outer surface until it is ready for use. Also, the tape unit can be used to interconnect two wall panels when the panels are in face-to-face relationship and form a double wall construction.

The primary object of this invention is to provide a wall assembly and method of constructing the same wherein quick-release fastening means is provided to interconnect the wall panels and the vertical studs which are provided to support the same to simplify the mounting of the wall panels and to eliminate the need for tongue and groove structures now utilized in construction of conventional walls.

Another object of this invention is to provide apparatus and a method of the type described wherein the fastening means provides a sound absorber and can be applied to either or both of a wall panel and a vertical stud for interconnecting the same, whereby sound travel through the wall is minimized and the fastening means can be applied either at a job site or a source of supply of the materials without adding materially to the cost of the wall construction itself.

A further object of this invention is to provide an improved wall assembly which includes a quick-release fastener in the form of an improved tape unit comprised of a first tape for attachment to a stud and a second tape releasably connected to the first tape and attachable to a wall panel with the bond between the second tape and the panel having a greater resistance to separation than that between the tapes themselves, so that the second tape will separate with the panel if the latter is moved away from the stud yet the second tape will provide a substantially smooth surface for re-attachment to the first tape to thereby allow the wall panel to be quickly attached to and removed from the stud a number of times even though the panel is made with cheap paper sides.

Other objects of this invention will become apparent as the following specification progresses, reference being had to the accompanying drawing for an illustration of an embodiment of the wall assembly.

In the drawing:

FIG. 4 is a perspective view of a stud showing another form of the quick-release fastening means thereon in the form of a number of tape units;

FIG. 5 is a perspective view of a tape unit used on the stud of FIG. 4;

FIG. 6 is a fragmentary, cross-sectional view of the wall assembly showing a wall panel secured to a stud by the tape unit of FIG. 5;

FIG. 7 is a view similar to FIG. 6 but showing the way in which the parts of the tape unit separate when the wall panel is removed from the stud; and FIG. 8 is a perspective view of the separated wall panel.

Figure 1:
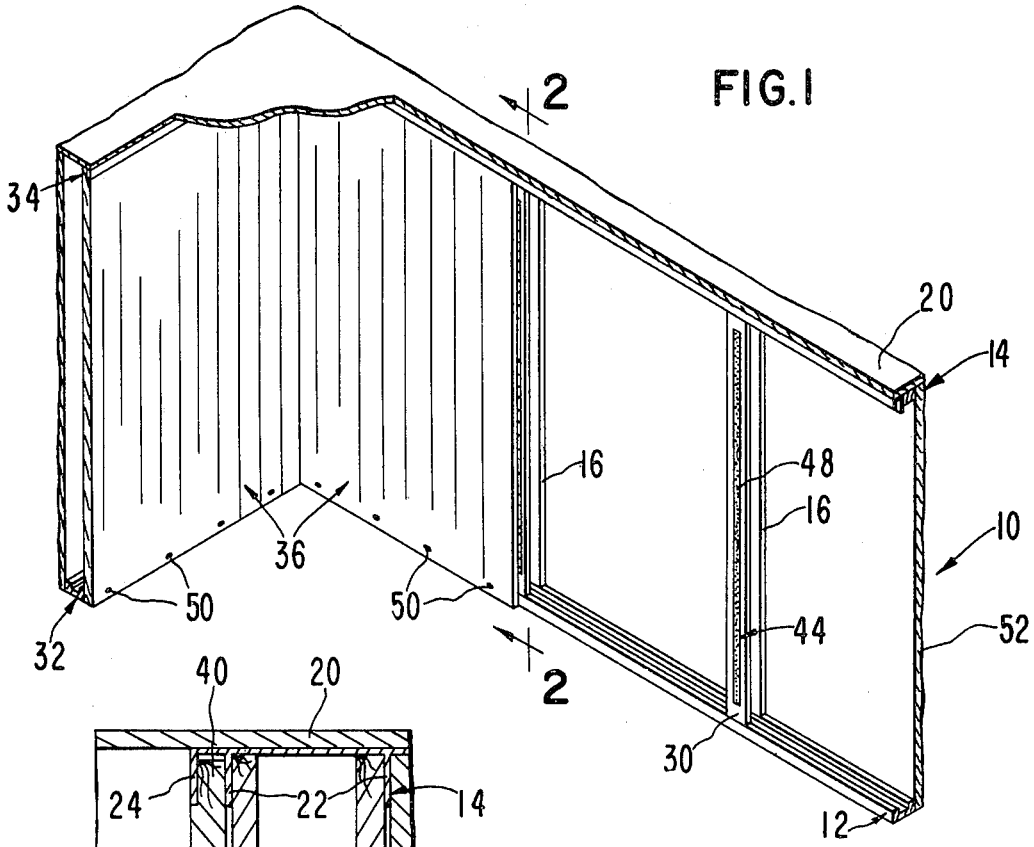
FIG. 1 is a perspective view of a portion of a wall assembly utilizing quick-release fastening means for interconnecting the wall panels and the adjacent vertical studs.

One form of the wall assembly of the present invention is shown in FIG. 1 and denoted by the numeral 10. Assembly 10 includes a floor runner 12, a ceiling runner 14, and a plurality of vertical studs 16 which interconnect runners 12 and 14. Runner 12 is adapted to be secured to the floor 18 of the space in which assembly 10 is to be constructed. Moreover, the cross section of runner 12 can be of any configuration but, for purposes of illustration, it is U-shaped as shown in FIG. 2.

Figure 2:
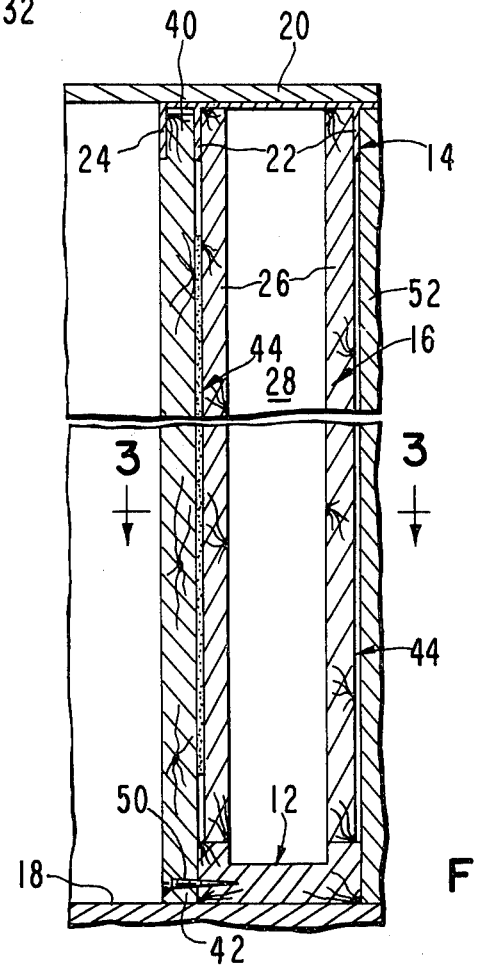
FIG. 2 is an enlarged, fragmentary, cross-sectional view taken along line 2—2 of FIG. 1.

Runner 14 is rigidly secured to the ceiling 20 in any suitable manner, runner 14 having, for purposes of illustration, a cross section of the type shown in FIG. 2. To this end, runner 14 has a pair of inner flanges 22 and a pair of outer flanges 24, only one of flanges 24 being shown in FIG. 2. Runner 14 is mounted directly above runner 12.

Each stud 16, for purposes of illustration, has an I-shaped cross section (FIG. 3), a pair of end flanges 26, and a central web 28 interconnecting flanges 26. Each flange 26 has a generally flat, outer face 30 which extends substantially along the length of the stud. Each stud is received between flanges 22 of runner 14 to confine the stud against movement laterally of the runner. Means (not shown) is provided for securing the lower end of each stud to runner 12.

As illustrated, assembly 10 has second runners 32 and 34 which connect with and are generally perpendicular to runners 12 and 14, respectively. The desired configuration of wall assembly 10 will, of course, determine the number of runners and their locations with respect to each other.

Assembly 10 includes a plurality of wall panels 36, each panel having a generally flat, inner surface 38 which is to be disposed adjacent to the flat, outer face 30 of at least one of the studs 16. Each panel 36 has an upper margin 40 (FIG. 2) which is received between flanges 22 and 24 of the upper runner and has a lower margin 42 which is disposed adjacent to floor 18. Each panel 36 may have any external ornamentation or surface texture and can even be perforated or grooved to provide an artistic appearance therefor. Generally, the height of each panel will be slightly less than the distance between floor 18 and the uppermost extremity of the recess defined by flanges 22 and 24 of runner 14. This feature is provided to allow the panel to be readily inserted into its operative position shown in FIG. 2 adjacent to a stud 16 by first tilting the panel before its upper margin 40 is inserted into the last-mentioned recess. Once margin 40 is received in the recess, the panel can be moved from the tilted position shown in dashed lines in FIG. 2 to the vertical or full line position of FIG. 2.

Quick-release fastening means 44 is provided to releasably interconnect each panel 36 and an adjacent stud 16 when the panel is in the operative position of FIG. 2. Fastening means 44 includes a first tape 46 secured to the inner surface 38 of panel 36 and a second tape 48 secured to surface 30 of the adjacent stud 16.

These tapes are of the type which mate and form a releasable connection therebetween. A fastener having these characteristics is a Velcro fastener which is comprised of two tapes, one being a hook tape and the other being a loop tape. For instance, tape 46 is the hook tape and tape 48 is the loop tape. They become interconnected due to the intertwining of the hooks and loops when the tapes are pressed together, such as when panel 36 is forced toward the adjacent stud 16. When this occurs, the panel is quickly and releasably connected to the stud. Permanent fasteners, such as screws 50, can then be used to secure the panel in place, the screws being driven through the bottom margin 42 of each panel 36 and into runner 12. The screws are the only permanent fasteners needed to hold a panel in place since upper margin 40 of the panel is effectively confined against lateral movement of the panel because of adjacent flanges 22 and 24.

Another quick-release fastener suitable for this purpose is a tape having an adhesive on both sides. The tape is initially applied either to the stud or to a panel. For instance, if one side of the tape is initially secured to the stud, the panel is connected thereto by being moved into engagement with the opposite side of the tape.

Other fasteners can be used, if desired. Such fasteners will operate to hold the panel adjacent to the stud after movement of the panel toward and into an operative position adjacent to the stud. Such other fastening means could be of the type which operates on the principle of magnetic or electrostatic attraction.

Fastening means 44 can be in the form of relatively long tapes or relatively short pieces placed at spaced locations along either or both of the panel and stud. The pieces can be of any shape. The same holds true in using double-backed tape or in using devices providing magnetic or electrostatic attraction forces.

In constructing assembly 10, runners 12 and 14, as well as other runners, if such are used, are placed on the floor and ceiling, respectively, following which studs 16 are put into place to form the framework against which the wall panels are supported. In the alternative, such framework can be made as an integral unit at a manufacturing site and carried to the job site intact.

Fastening means 44 used with wall assembly 10 can be placed on the studs and panels either at the job site or at a source of the panels and studs. If placed at the source, the fastening means can be protected such as by covering the working surface or surfaces of such fastening means with a release paper to prevent dirt or other foreign matter from adhering to it.

Assuming that fastening means 44 has been installed either on the panels, on the studs, or on both, each panel is moved toward a stud and tilted slightly to permit the upper margin 40 thereof to be received within the recess defined by flanges 22 and 24 of the upper runner. Then the panel is moved into the recess, following which it is moved from the tilted position into a vertical position and allowed to rest on floor 18. As it is moved into its vertical position, it is forced toward the adjacent stud so that the fastening means operates to releasably interconnect the stud and the panel. Then, screws 50 are driven into place to hold the panel permanently in its operative position. The next panel is then moved into its operative position directly adjacent to and in abutment with the panel previously mounted in place.

Figure 3:
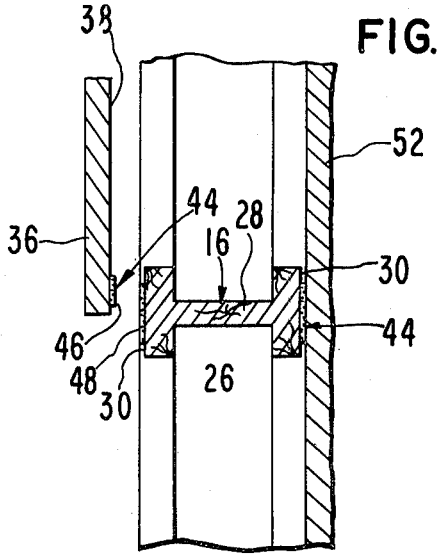
FIG. 3 is a fragmentary, cross-sectional view taken along line 3—3 of FIG. 2, with one of the wall panels separated from the adjacent vertical stud to illustrate the fastening means on both the wall panel and the stud.

FIGS. 1, 2 and 3 also illustrate that both ides of wall assembly 10 can be constructed in the foregoing manner. For purposes of illustration, a panel 52 is connected by fastening means 44 to the opposite flange of the stud shown in FIGS. 2 and 3. The vertical margin of a panel need not be adjacent to the flange of the stud although such features is shown with respect to panel 36 in FIG. 3.

It is clear that panels 36 do not need tongues and grooves as are presently used for mounting conventional wall panels. However, panels 36 may have tongues and grooves on their vertical side margins, if desired. Thus, conventional wall panels can be used to carry out the teachings of this invention if it is desired to deplete a stock of such panels before using panels without tongues and grooves.

Wall assembly 10 can be quickly disassembled by removing screws 50 and then tilting panels 36 away from the studs. This can be done because the fastening means 44 will readily permit the separation of the panels from the studs.

Another form of the quick-release fastening means of this invention is shown in FIGS. 4–8 and comprises a flexible tape unit having a first tape 62 adapted to be bonded to the outer face 30 of a stud 16 and a second tape 64 adapted to be bonded to the inner surface of a wall panel, whereby the panel is releasably coupled to the stud. For purposes of illustration, a pair of tape units 60 are mounted on each flange 26, respectively, of stud 16. First tape 62 has both of its faces provided with an adhesive; whereas, second tape 64 has only its outer face 66 provided with the adhesive, its inner face 68 being substantially smooth and preferably somewhat glossy to permit it to quickly and easily adhere to first tape 62. A strip 70 of release paper on the outer face 66 of second tape 64 is used to protect the same until it is ready for use, at which time layer 70 is peeled off and discarded.

Tape unit 60 is especially suitable for use with drywall panels of gypsum or other similar materials. Such a panel has its sides covered with paper of poor quality, such as newspaper quality. When a tape applied to the paper side is peeled off, it causes the paper to fray or become fuzzy and to form loose mats of dangling paper fibers along the portion from which the tape was removed. Also, the tape strips off some of these fibers which destroys or seriously limits the adhesive layer on the tape. The loose paper fibers prevent any tape from making a good, firm bond to the panel. Essentially, therefore, the tape is only usable one time and must be replaced. Also, the fuzzy areas must be covered with a suitable strip which presents a smooth outer surface for attachment to the new tape.

Tape unit 60 overcomes this problem because of the fact that second tape 64 firmly adheres to the cheap paper siding of a drywall panel so that if the panel must be removed from its operative position adjacent to a stud, tape 64 remains on the panel and is separated from base tape 62. Thus, surface 68 of tape 64 then becomes the outer surface of a narrow strip of the panel and, since surface 68 is smooth or preferably glossy, it provides the proper surface for quick and easy attachment to tape 62 when the panel is again put into place adjacent to the stud. This is illustrated in FIGS. 6–8, wherein FIG. 6 shows a panel secured by tape unit 60 to a stud 16. FIG. 7 shows the panel separated from its connection with the stud with second tape 64 attached to the panel, thereby exposing the outer face of first tape 62. FIG. 8 also shows the way in which second tape 64 remains on the panel after it has been separated from the stud.

Tape 64 is carried away from tape 62 when the wall panel is removed from the stud because the bond between tape 64 and the panel has greater resistance to separation than the bond between the two tapes 62 and 64. This can at least be partly achieved by making the tapes of suitable materials such as thin, flexible plastic foam material for tape 62 and a flexible paper strip for tape 64, the paper strip being of better quality than the paper on the panel side.

Generally, the tape units 60 will initially be placed on the flanged surfaces 30 of studs 16 before the studs are shipped to the job site. This can be done by machine to minimize production costs. The tape unit can be manufactured with the three layers, namely tape 62, tape 64 and release paper strip 70. The tape can be supplied in rolls and readily applied to the flange outer faces as desired. For purposes of illustration, the tapes extend along the entire length of the flange but can be of shorter lengths as desired.

The quick-release fastener provided by a tape unit 60 is not limited for use with studs 26. For instance, it may be necessary to attach a pair of panels together when the panels are in facing relationship to each other. In such a case, tape unit 60 can be disposed on a first of the panels so that when the second panel is moved into place adjacent to the first panel, it will adhere to the outer, second tape 64. When the second panel is removed from the first panel, second tape 64 remains secured to the second panel and will provide a smooth, glossy outer surface for re-attachment to the base tape which remains on the first panel.

A wall assembly utlizing tape unit 60 is constructed in essentially the same way as that described above with quick-release fastening means 44.

We claim:

1. In a method of constructing a wall: providing a generally upright stud and a wall panel; providing a pair of tapes between the stud and the wall panel with the tapes having adhesive thereon and capable of being releasably and adhesively bonded together; and moving the wall panel toward and into an operative position adjacent to the stud with the tapes engaging each other and being adhesively bonded together and with one tape being bonded to the stud and the other tape being bonded to the wall panel, whereby the tapes couple the wall panel to the stud, the bonding strength between the two tapes being less than that between the wall panel and the other tape, whereby the other tape will adhere to said wall panel and separate from said one tape when the wall panel is moved away from the stud.

* * * * *